US009064657B2

(12) United States Patent
Bunk et al.

(10) Patent No.: US 9,064,657 B2
(45) Date of Patent: Jun. 23, 2015

(54) SWITCHING UNIT FOR AN ELECTRICAL SWITCHING DEVICE

(71) Applicants: Thomas Bunk, Sulzbach-Rosenberg (DE); Reinhard Herdegen, Amberg (DE); Siegfried Pirker, Ensdorf (DE)

(72) Inventors: Thomas Bunk, Sulzbach-Rosenberg (DE); Reinhard Herdegen, Amberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 96 days.

(21) Appl. No.: 13/752,552

(22) Filed: Jan. 29, 2013

(65) Prior Publication Data

US 2013/0206557 A1 Aug. 15, 2013

(30) Foreign Application Priority Data

Feb. 9, 2012 (DE) ..... 10 2012 201 941

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 21/04*** | (2006.01) |
| ***H01H 71/02*** | (2006.01) |

(52) U.S. Cl.

CPC ..... *H01H 21/04* (2013.01); *H01H 71/0207* (2013.01); *H01H 71/0214* (2013.01)

(58) Field of Classification Search

CPC ..... H01H 73/00; H01H 75/00; H01H 77/00; H01H 83/00; H01H 2009/00; H01H 2223/00; H01H 2223/01; H01H 2237/00

USPC ..... 200/293, 296, 297, 5 R, 5 B, 5 C, 6 R, 200/19.18, 19.2, 19.22, 19.27, 19.3, 49, 200/553, 558, 339

See application file for complete search history.

(56) References Cited

U.S. PATENT DOCUMENTS

| | | | | |
|---|---|---|---|---|
| 6,072,136 | A * | 6/2000 | Wehrli et al. | 200/401 |
| 6,172,585 | B1 * | 1/2001 | Zindler et al. | 335/202 |

FOREIGN PATENT DOCUMENTS

| | | | |
|---|---|---|---|
| DE | 29503476 | U1 | 7/1996 |
| DE | 102006038191 | B3 | 11/2007 |
| EP | 1643523 | A2 | 4/2006 |
| WO | WO 2006120141 | A1 | 11/2006 |
| WO | WO 2007009406 | A1 | 1/2007 |

* cited by examiner

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A switching unit for an electrical switching device, in particular for an electrical power circuit breaker, is disclosed and includes a breaker mechanism with an operating lever and a switching mechanism which can be actuated by the operating lever. In at least one embodiment, at least one breaker assembly board is included, onto which the breaker mechanism is fixed. The at least one breaker assembly board includes at least one positioning lug which is designed for positioning the switching unit in a housing of the electrical switching device.

12 Claims, 4 Drawing Sheets

SWITCHING UNIT FOR AN ELECTRICAL SWITCHING DEVICE

PRIORITY STATEMENT

The present application hereby claims priority under 35 U.S.C. §119 to German patent application number DE 10 2012 201 941.3 filed Feb. 9, 2012, the entire contents of which are hereby incorporated herein by reference.

FIELD

At least one embodiment of the present invention generally relates to a switching unit for an electrical switching device, together with an electrical switching device, in particular an electrical power circuit breaker.

BACKGROUND

Switching units for electrical switching devices, together with corresponding electrical switching devices are well-known in principle. They normally have a breaker mechanism with an operating lever. Furthermore, an actuatable switching mechanism which can be actuated by the operating lever is often provided for such a breaker mechanism. Over and above this, for the purpose of affixing the breaker mechanism, a breaker assembly board is generally provided, in particular with a plate-like format. The breaker mechanism is attached to this breaker assembly board, for example by means of rivets, which can function in addition as bearing points or bearing shafts, as appropriate.

A disadvantage of the known switching units is the fact that the positioning of the breaker mechanism within an electrical switching device, in particular within a housing of the electrical switching device, is only possible at considerable expense, or with a long tolerance chain, as applicable. Thus, in the case of the known switching devices, such as for power circuit breakers, the switching units are arranged in a lower housing part, onto which is fixed in turn an upper housing part.

However, the most accurate possible alignment of the breaker mechanism is desired, in particular of the operating lever or the switching mechanism, as appropriate. This is because, in the case of the known switching units, the movement of an operating lever and/or the movement of the switching mechanism can fulfill not merely one but two or even more functions. This means, for example, that mechanical interfaces are provided which, when the operating lever is moved between two positions, transfer the movement not only to the switching mechanism but also to another mechanism, for example an actuator.

In order to ensure that this transfer functions in a mechanically reliable way, the most accurate possible geometric positioning of the switching unit within the electrical switching device is of critical importance. However, if the positioning of the switching unit within the electrical switching device has several locating stops which are subject to tolerances, forming a tolerance chain, there is a danger that an insufficiently accurate positioning arises. This can only be avoided by specifying particularly close tolerance requirements for the individual components, so that the cumulative overall tolerance of this tolerance chain lies within the permissible range. This leads to high costs in the manufacture of the individual components, in particular for the switching unit, the housing components and other components of the switching device.

SUMMARY

An embodiment of the present invention eliminates, at least in part, at least one of the above disadvantages of known switching units and known electrical switching devices. In particular, an embodiment of the present invention makes available a switching unit for an electrical switching device together with an electrical switching device, in particular a power circuit breaker, with which the switching unit can be cost-effectively and simply positioned with the greatest possible accuracy in the electrical switching device.

Further features and details of the invention are implied by the sub-claims, the description and the drawings. Here, the features and details which are described in connection with the inventive switching unit also apply, of course, in connection with the inventive switching device, and vice versa in each case, so that in relation to the disclosure of the individual inventive aspects reciprocal reference always is or can be made, as applicable.

A switching unit in accordance with an embodiment of the invention for an electrical switching device, in particular for an electrical power circuit breaker, has a breaker mechanism. This breaker mechanism has an operating lever and a switching mechanism which can be actuated using the operating lever. In addition, the switching unit has at least one breaker assembly board.

BRIEF DESCRIPTION OF THE DRAWINGS

The above invention is explained in more detail by reference to the attached drawing figures. The terms "right" and "below" used here relate to an orientation of the drawing figures where the reference marks are normally readable. Shown schematically are.

Figure 1A:
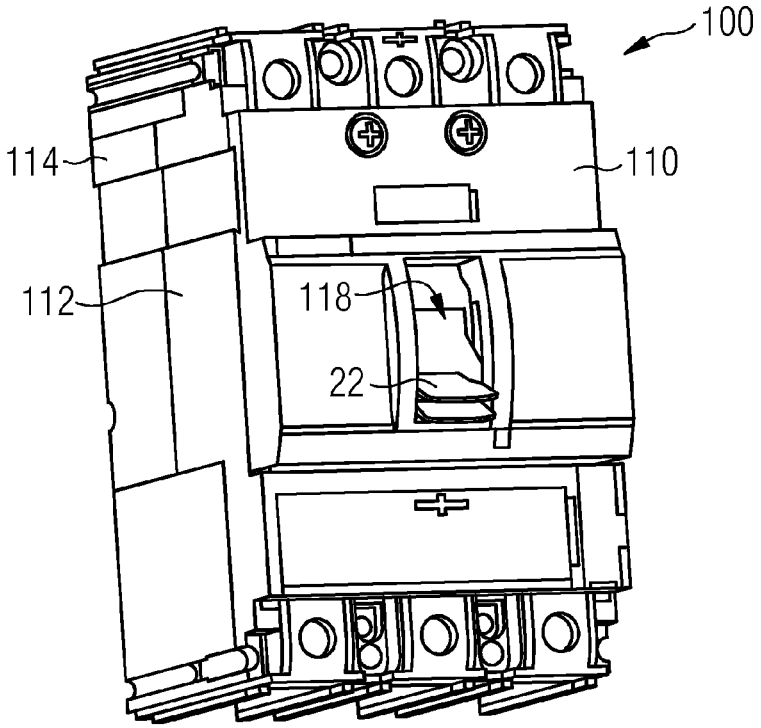
FIG. 1*a* a first form of embodiment of an electrical switching device in accordance with an embodiment of the invention, FIG. 1*b* the electrical switching device in FIG. 1*a* with the housing opened, FIG. 2 a schematic partial cutaway of the form of embodiment in FIG. 1*a*, FIG. 3 another schematic partial cutaway of the form of embodiment in FIG. 1*a*, FIG. 4 a schematic partial cutaway of a form of embodiment of a positioning lug, FIG. 5 a schematic partial cutaway of another form of embodiment of a positioning lug in accordance with an embodiment of the invention, and FIG. 6 a perspective partial view of another form of embodiment of a positioning lug in accordance with an embodiment of the invention.

In the figures, elements with the same function and way of working have each been given the same reference mark.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A switching unit in accordance with an embodiment of the invention is distinguished by the at least one breaker assembly board having at least one positioning lug. This positioning lug is designed for positioning the switching unit in a housing of the switching device. In other words, with a switching unit in accordance with the invention, the switching unit can be positioned directly by way of the positioning lug.

Unlike known switching units which were positioned indirectly, for example using the external dimensions of the switching unit itself, or assembly aids such as screws or rivets, in accordance with an embodiment of the invention direct positioning of the switching unit is effected. Positioning, in particular by way of the positioning lug, is effected directly on a component which is of great importance for the positioning. This could be, for example, a housing upper part of the switching device, relative to which is positioned another switching unit or another switch, for example, which is to be switched by the operating lever as a second function.

By comparison with known switching units in accordance with the prior art, an inventive development results in the avoidance of long tolerance chains in the positioning of the switching unit. This provides the desired accuracy of positioning for the mechanical functioning of primary and secondary switching functions. Furthermore, a larger tolerance range can be specified for the manufacture of the individual components, because this tolerance range is determined independently, or partly independently, of the positioning accuracy of the switching unit in the electrical switching device.

The breaker assembly board will preferably be plate-like, in particular essentially flat, in form. It can be formed, for example, from metal, preferably from steel. Rivets or other fixing arrangements are used for attaching the switching mechanism onto the breaker assembly board. These fixing arrangements can also be designed as a means of location, for example as bearing shafts, for other components.

As the operating lever, the breaker mechanism itself has, for example, a plastic component which is equipped with a grip section. Using this grip section, the operating lever can be moved back and forward between preferably at least two positions. It is also possible for the operating lever to occupy several positions during the course of this movement. The direction of movement can also be labeled as the switching direction of the operating lever. The switching mechanism serves, in particular, to transfer the movement of the operating lever into the interior of the switching unit or into the interior of the electrical switching device. For this purpose, the switching mechanism can have, for example, a lever mechanism. It is also conceivable within the ambit of an embodiment of the present invention that spring elements, in particular helical springs, are provided for the switching mechanism.

Such a switching unit can be designed for switching by way of the switching mechanism and in addition for switching a further mechanism, as a secondary function. This further mechanism can also be referred to as an accessory component. This accessory component can be built into an electrical switching device either selectively or as a fundamental element, so that a switching unit in accordance with an embodiment of the invention has equal functional competence for a variation with or without an accessory component. Such an accessory component can, for example, also be actuated using the operating lever. This operating lever can therefore have a contact surface which engages in a mechanical interaction with such an accessory component as soon as the operating lever of the inventive switching unit is moved into a position provided for this purpose.

In the context of an embodiment of the present invention, the term positioning lug is to be understood, in particular, as a geometric formation which can be pushed into a corresponding positioning opening. Such a form of positioning lug can be achieved, for example, by an essentially flat, in particular planar, protrusion. The positioning lug will preferably be in the form of an extension of the breaker assembly board, where the thickness of the rest of the breaker assembly board is no different, or only slightly, from the thickness of the positioning lug.

The positioning of a switching unit in accordance with an embodiment of the invention by way of the positioning lug is preferably effected in the direction of switching of the operating lever, as it has been defined above. The purpose of the positioning is to establish a defined position for the breaker assembly board, or the breaker mechanism attached thereto, as appropriate. The breaker mechanism is thus positioned with no tolerance chain, or only a short one, so that when used for a secondary function of switching the accessory component this improved positioning leads to improved or reliable switching of this accessory component, as applicable.

A switching unit in accordance with an embodiment of the invention can to this end be developed in such a way that a breaker assembly board is arranged on each of the two sides of the breaker mechanism. Both of these breaker assembly boards will have at least one positioning lug and they will, in particular, be arranged parallel to one another or essentially parallel. The provision of at least two breaker assembly boards brings with it the advantage that they surround the breaker mechanism on both sides, in particular like a sandwich. The preferably parallel alignment of the side assembly boards makes possible a parallel alignment of the positioning lugs. This makes it possible to effect two-sided positioning, that is on both sides of the breaker mechanism. By this, skewing of the breaker mechanism after or during the positioning can be reduced, or avoided, as appropriate. This form of embodiment produces, in particular, multiple or dual positioning, as applicable. In particular when several accessory components are used, that is for several different secondary switching functions of the switching unit, such double positioning can yet further increase the positioning accuracy in accordance with an embodiment of the invention.

An advantage can also be achieved in that, for a switching unit in accordance with an embodiment of the invention, the at least one breaker assembly board and the at least one positioning lug have an essentially flat format. This essentially flat format is, in particular, designed to be parallel to or essentially parallel to the direction of switching of the operating lever. In addition, the positioning in the direction of switching is yet further simplified. This relates in particular to a component bent from plate and/or a part stamped out from sheet metal. The breaker assembly board and with it also the positioning lug can in this way be manufactured particularly cost-effectively. So it is possible to manufacture an inventive form of embodiment of such a breaker assembly board from sheet steel by bending or stamping, that is by cost-effective manufacturing steps.

A further advantage is achieved in that the positioning lug on such an embodiment of an inventive switching unit has at least two contact surfaces and/or contact edges. These contact surfaces and/or contact edges are opposite each other and are aligned, in particular, along the switching direction of the operating lever. The term contact surface is to be understood as a surface which can come into physical contact with a counterpart, for example a wall surface of the switching device, in particular of an upper housing part of the switching device. The same applies to the function of the contact edges, which can bear upon an opposing edge or opposing surface of the switching device, in particular of the housing. In other words, the contact surfaces can serve the purpose of avoiding a displacement in a direction normal to the contact surface or normal to the contact edge.

The provision of at least two opposing contact surfaces serves to prevent a positioning in a first direction and in a second direction which is, in particular the direction of switching. In other words, the two locating directions lie along an axis or straight line and are aligned in opposing directions to each other. By this means, the positioning is effected inventively for both directions of movement along the switching direction of the operating lever. In particular, the contact surfaces will be the side surfaces, or the side edges or edges of intersection of such a positioning lug, which are provided by the thickness of such a positioning lug, which is in particular in the form of a sheet material. This permits especially simple and above all especially robust positioning, in particular in the two directions of movement along the switching direction.

Another subject of an embodiment of the present invention is an electrical switching device, in particular an electrical power circuit breaker such as a compact power circuit breaker, having a housing with a housing upper part and a housing lower part. The housing upper part and housing lower part enclose a housing interior space. An electrical switching device in accordance with an embodiment of the invention is distinguished by the fact that a switching unit in accordance with an embodiment of the present invention is arranged in the interior space of the housing. The operating lever of the switching unit protrudes through a switch aperture in the housing upper part and at least from outside the housing can be gripped and moved along its switching direction.

The remainder of the switching unit, in particular the switching mechanism, is arranged in the interior space of the housing of the switching unit. Positioning of the switching unit is preferably effected relative to the housing, in particular relative to the housing upper part, by means of the positioning lugs. Since further accessory components will preferably be affixed to this housing upper part, the switching unit will be positioned relative to the same component, namely the housing upper part, as for such accessory components. In this way, the tolerances of the positioning, between the two components which interact mechanically, namely between the accessory component and the switching unit, are reduced to a minimum, so that the same advantages can be achieved as have already been fully explained in relation to a switching unit in accordance with the invention. The housing upper part and the housing lower part of an electrical switching device in accordance with an embodiment of the invention are preferably joined to each other. In particular, these two components interlatch with each other.

An electrical switching device in accordance with an embodiment of the invention is capable of further development in that the housing upper part in particular has at least one positioning opening aligned into the interior space of the housing. The at least one positioning lug is arranged in this positioning opening for the purpose of positioning the breaker mechanism relative to the housing upper part. In particular, the positioning lug is pushed or plugged into this positioning opening. The positioning opening is provided, in particular, on a component which is designed for the attachment of further components, in particular with actuating elements. The direction of this pushing-in will preferably be across the direction of switching, in order to prevent the position changing in an unwanted way. It is also possible to effect non-destructively a disassembly or desired change of position, as appropriate.

It can be of further advantage if, for an electrical switching device in accordance with an embodiment of the invention, the at least one positioning opening has at least two wall surfaces. These two wall surfaces are designed for positioning the breaker mechanism with respect to the switching direction of the operating lever, by physical contact with outer surfaces of the at least one positioning lug, in particular the contact surfaces and/or the contact edges. These wall surfaces can also be referred to as inner surfaces or inner walls of the positioning opening. By their coming up against the contact surfaces and/or contact edges of the switching unit, it is possible to achieve the prevention of movement of the positioning lug. Movement beyond this locating stop is not possible, because the geometric correlation of these wall surfaces of the positioning opening and the contact surfaces and/or contact edges on the switching unit make such a movement impossible. In particular, this provides a reference to the switching direction of the operating lever, so that the desired positioning in this direction is effected. The positioning will preferably be effected with little play. Naturally, it is also possible to provide more than two corresponding wall surfaces, so that it is possible to effect not merely a single positioning but multiple positioning in more than one positioning direction.

There is a further advantage if at least one plastically and/or elastically deformable rib is arranged in the at least one positioning opening on an electrical switching device in accordance with an embodiment of the invention. This rib is designed to reduce the play in at least one direction, between the positioning lug and the positioning opening, when the positioning lug is moved into the positioning opening. Such a rib can, in particular, be a deformable rib or a barbed rib. It can deform or even break off completely. When such a rib breaks off, the fragments will wedge themselves in the gap between the neighboring surfaces, so that the play is reduced in the desired way. Deformation is also possible, so that the desired positioning between the positioning lug and the positioning opening is effected, preferably, in the form of a force fit. A conceivable alternative or addition to a rib of this type is a shaping, of the wall of the positioning opening and/or of the positioning lug, which can be deformed during the joining operation, and hence in particular creates a positive fit.

It is also advantageous if, on an electrical switching device in accordance with an embodiment of the invention, at least two positioning openings with different opening cross-sections are arranged in such a way that they match up with at least two specific positioning lugs on the switching unit for one defined installation position of the switching unit. This means that, from a geometric viewpoint, the two positioning openings differ from each other. Hence the two positioning lugs must preferably also differ from one another geometrically. With this form of embodiment, any particular positioning lug is designed to be specific to a single positioning opening. This prevents misassembly, because the components which are to be joined together, in particular the switching unit and the housing upper part, can only be assembled in the alignment determined by the positioning openings. During assembly, this protects against the possibility of incorrect assembly, so that an electrical switching device in accordance with the invention can be yet further improved. The same can also be achieved, for example, by appropriate special shaping of the positioning lug.

It is a further advantage if, for an electrical switching device in accordance with an embodiment of the invention, the direction of insertion is identical or essentially identical for all the positioning openings and positioning lugs. This again simplifies the assembly, because even when a plurality of positioning lugs is used there is a single direction of insertion. This makes it possible to push the switching unit into the appropriate component of the switching device, in particular the housing upper part, with a single movement.

In the case of an electrical switching device in accordance with an embodiment of the invention it can also be advantageous if the direction of insertion of all the positioning openings and positioning lugs is across the direction of switching of the operating lever. This alignment across, in particular perpendicular to, the direction of switching results in the advantage that it is possible to avoid the operating lever moving out of position in an unwanted way. In particular during movement of the operating lever along the direction of switching, this ensures and maintains reliable and effective positioning or securing of the operating lever, and also transfer of the force from its movement by appropriate surfaces of the switching unit.

Figure 1B:
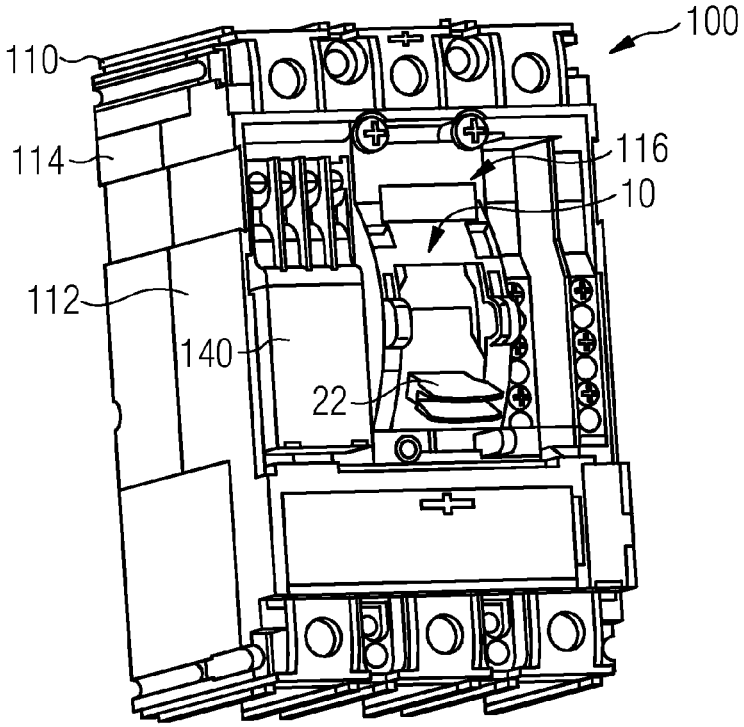

FIGS. 1*a* and 1*b* show a form of embodiment of an electrical switching device 100 in accordance with the invention. This electrical switching device 100 is shown in FIG. 1*a* in a closed state, and in FIG. 1*b* in an open state. In the closed state as shown in FIG. 1*a*, the electrical switching device 100 has a housing 110 which consists of a housing lower part 114 and a housing upper part 112. In addition to this, a switch aperture 118 is provided, through which an operating lever 22 protrudes. In other words, in the state shown in FIG. 1 the operating lever 22 can be actuated for the purpose of switching a switching mechanism 24 lying behind it.

In FIG. 1*b*, a housing cover on the housing 110, in particular on the housing upper part 112, has been removed. It can be seen here that an accessory component 140 has been arranged, and this also has an actuating element, 142, as can be seen for example in FIG. 2. The accessory component 140 can, for example, be arranged at some later time, and is in particular screwed onto the housing upper part 112 of the housing 110. Also to be seen in FIG. 1*b* is the housing interior space 116, in which is arranged the switching unit 10. The operating lever 22 is also shown after removal of a housing cover of the housing 110.

Figure 2:
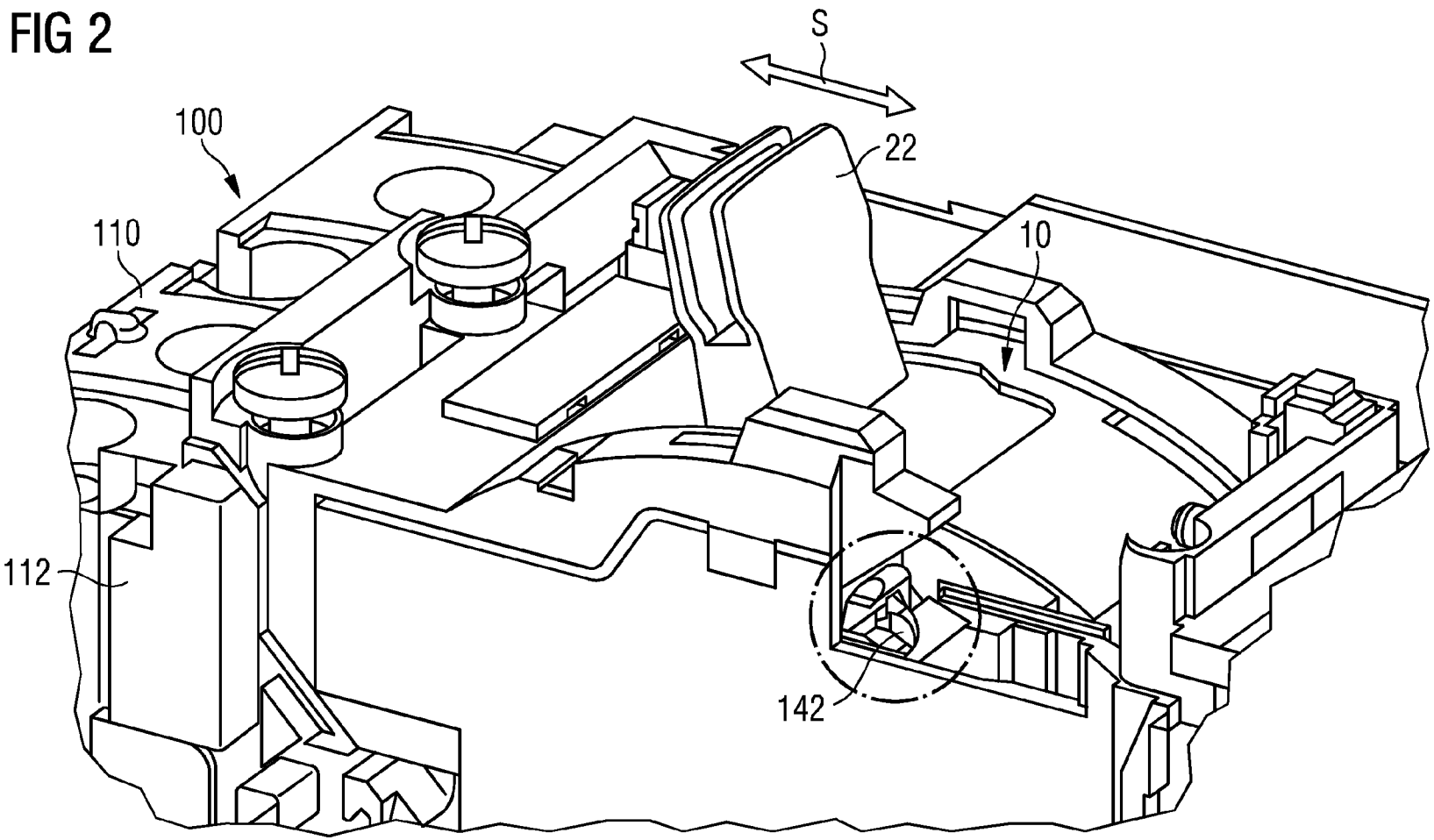

It can be seen in FIG. 2 that when an accessory component 140 is arranged, as shown in FIG. 1*b*, an actuating element 142 of this accessory component 140 is also to be switched by the operating lever 22 of the switching unit 10. If the operating lever 22 moves as shown in FIG. 2 towards the bottom right along its direction of switching S, then an appropriate mechanical interface on the operating lever 22 will come into working contact with the actuating element 142 of the accessory component 140, and switch this actuating element 142.

Figure 3:
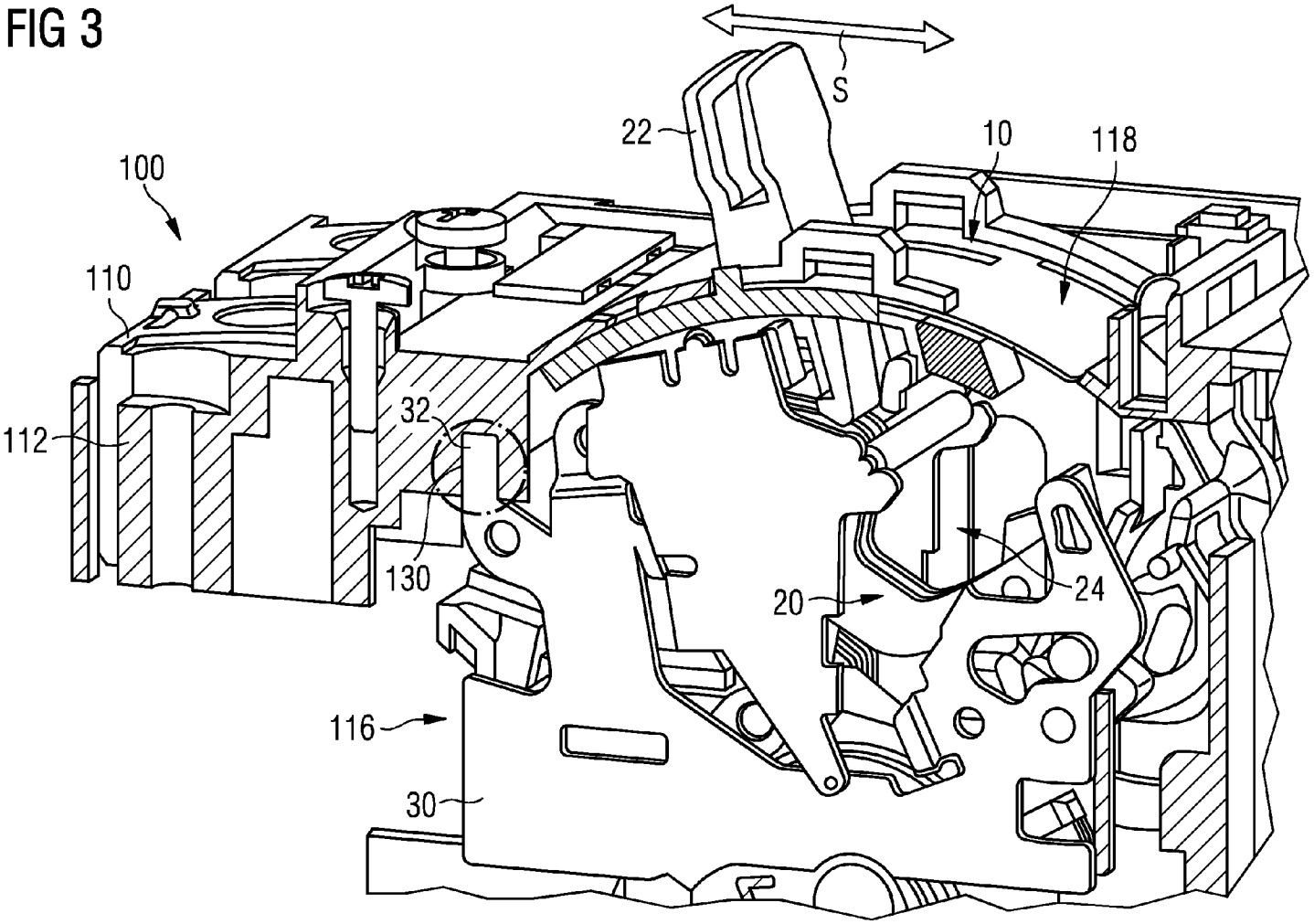

As already explained, this accessory component 140 is affixed relatively on the housing upper part 112 and is thereby positioned relative to this housing upper part 112. In order now to position in addition the operating lever 22 or the switching unit 10, as appropriate, relative to this housing upper part 112, a positioning lug 32 is provided in each case on a breaker assembly board 30 of the switching unit 10. An example of such a breaker assembly board 30 with such a positioning lug 32 is shown in FIG. 3. It is of course possible that another breaker assembly board 30, with another positioning lug 32 with the same type of formation, is provided on the opposite side, which is not shown, that is behind the operating lever 22.

FIG. 3 shows a schematic cutaway, which shows the inserted position of the positioning lug 32 in a positioning opening 130 in the housing upper part 112. During assembly the switching unit 10 is, as shown in FIG. 3, inserted from below into the housing upper part 112, so that the operating lever 22 protrudes through the switch aperture 118. In doing this, the positioning lug 32 or the plurality of positioning lugs 32 is/are pushed into the appropriate positioning openings 130. This insertion effects a correlation between the contact surfaces 34 and the wall surfaces 132 of the positioning opening, thus effecting the desired positioning in the direction of switching S. Further details of this will be explained by reference to FIGS. 4, 5 and 6.

Figure 4:
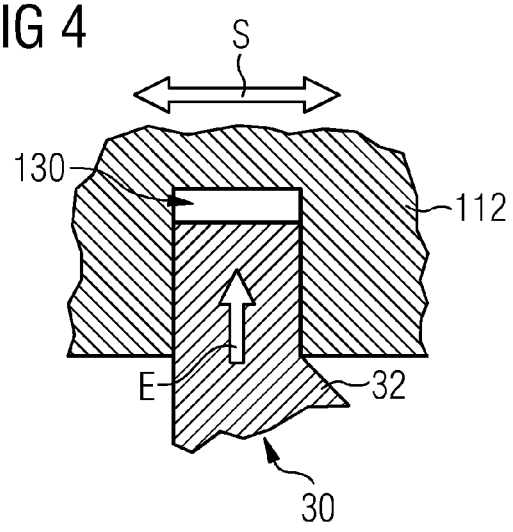
Figure 5:
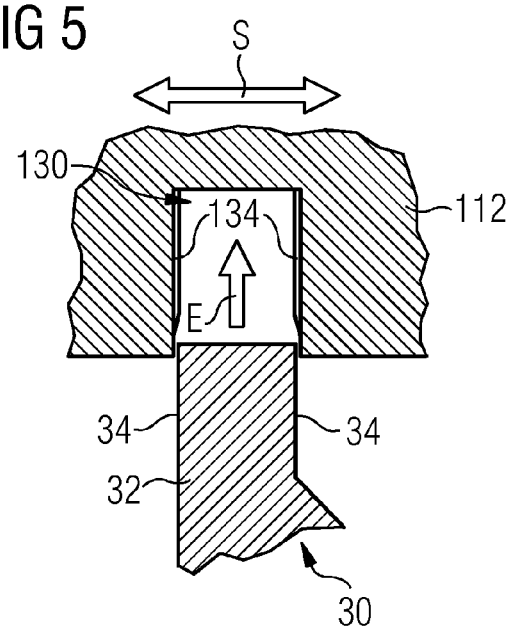

FIG. 4 shows a form of embodiment of a positioning lug 32 on a breaker assembly board 30. The direction of insertion E is shown by an arrow and is essentially across the direction of switching S. The positioning lug 32 is inserted in a positioning opening 130 in the housing upper part 112. This insertion can be effected, for example, in the way shown for the form of embodiment in FIG. 5. In FIG. 5, the positioning lug 32 is still outside the positioning opening 130. On both sides of the positioning lug 32, contact surfaces 34 are provided, which can come into contact with the wall surfaces 132 of the positioning opening 130. In addition, in the case of the form of embodiment shown in FIG. 5, deformable ribs 134 are provided which the positioning lug 32, when it is pushed in along the direction of insertion E, deforms or breaks off, as applicable. The play between the contact surfaces 34 and the wall surfaces 132 of the positioning opening 130 is thereby reduced or completely avoided, as applicable, so that there is preferably a close fit.

Figure 6:
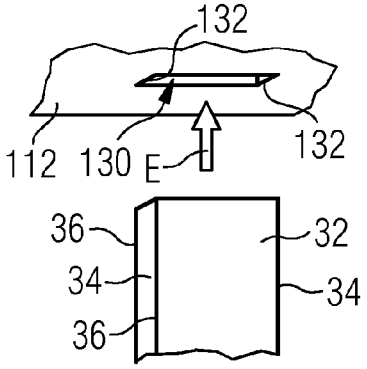

In FIG. 6 it can be seen in the perspective view that, apart from contact surfaces 34 for the positioning lug, contact edges 36 can also become effective. These will preferably engage with corresponding edges between wall surfaces 132 of the positioning opening 130, so that here again positioning is effected, preferably across the direction of switching S.

The above explanation of the forms of embodiment describes the present invention only in the context of examples. Individual features of the forms of embodiment can, of course, where technically meaningful be freely combined with each other without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE CHARACTERS

10 Switching unit
20 Breaker mechanism
22 Operating lever
24 Switching mechanism
30 Breaker assembly board
32 Positioning lug
34 Contact surface
36 Contact edge
100 Switching device
110 Housing
112 Housing upper part
114 Housing lower part
116 Housing interior space
118 Switch aperture
130 Positioning opening
132 Wall surface of the positioning opening
134 Deformable rib
140 Accessory component
142 Actuating element of the accessory component
S Switching direction
E Insertion direction

What is claimed is:

1. A switching unit for an electric switching device, comprising:

a breaker mechanism including an operating lever;

a switching mechanism, actuatable by the operating lever; and at least one breaker assembly board to which the breaker mechanism is attached, the at least one breaker assembly board including at least one positioning lug, for positioning the switching unit in a housing of the electric switching device, wherein the at least one breaker assembly board includes a first breaker assembly board and a second breaker assembly board on opposite sides of the breaker mechanism, and the at least one positioning lug includes a first positioning lug that is a part of the first breaker assembly board and a second positioning lug that is a part of the second assembly board, the first positioning lug having a different geometrical shape than the second positioning lug, the first positioning lug and the second positioning lug being flat in a direction parallel to a direction of switching the operating lever, the first positioning lug and the second positioning lug being at same locations on their respective assembly boards.

2. The switching unit of claim 1, wherein the first breaker assembly board and the second breaker assembly board are arranged parallel or essentially parallel to one another.

3. The switching unit of claim 1, wherein the each of the first and second positioning lugs includes at least two contact surfaces and/or contact edges, aligned in opposite directions from each other and aligned along the direction of switching of the operating lever.

4. An electrical switching device, comprising:

a housing including a housing upper part and a housing lower part, surrounding a housing interior space; and a switching unit, arranged in the housing interior space, the switching unit including, a breaker mechanism including an operating lever, a switching mechanism, actuatable by the operating lever, and at least one breaker assembly board to which the breaker mechanism is attached, the at least one breaker assembly board including at least one positioning lug, for positioning the switching unit in a housing of the electric switching device, wherein the at least one breaker assembly board includes a first breaker assembly board and a second breaker assembly board on opposite sides of the breaker mechanism, and the at least one positioning lug includes a first positioning lug and a second positioning lug, the first positioning lug having a different geometrical shape than the second positioning lug, wherein the operating lever protrudes through a switch aperture in the housing upper part, wherein the housing upper part includes first and second positioning openings directed into the housing interior space, in which are arranged the first and second positioning lugs for positioning the breaker mechanism relative to the housing upper part, and wherein at least one plastically and/or elastically deformable rib is arranged in the first and second positioning openings between the first and second positioning lugs, such that play is reduced in at least one direction when the first and second positioning lugs are moved into the first and second positioning openings.

5. The electrical switching device of claim 4, wherein each of the first and second positioning openings includes at least two wall surfaces which, by their contact with the outer surfaces of a respective one of the first and second positioning lugs, position the breaker mechanism with respect to a direction of switching of the operating lever.

6. The electrical switching device of claim 4, wherein the housing upper part includes at least two positioning openings with different opening cross-sections so as to match up with the first and second positioning lugs on the switching unit for one defined installation position of the switching unit.

7. The electrical switching device of claim 4, wherein a direction of insertion is identical or essentially identical for all the positioning openings and positioning lugs.

8. The electrical switching device of claim 4, wherein a direction of insertion of all the positioning openings and positioning lugs is transverse to a direction of switching of the operating lever.

9. The switching unit of claim 1, wherein the switching unit is for an electric power circuit breaker.

10. The switching unit of claim 2, wherein the first and second positioning lugs include at least two contact surfaces and/or contact edges, aligned in opposite directions from each other and aligned along the direction of switching of the operating lever.

11. An electric power circuit breaker, comprising the switching unit of claim 1.

12. An electrical switching device, comprising:

a housing including a housing upper part and a housing lower part, surrounding a housing interior space; and the switching unit of claim 1, arranged in the housing interior space.

* * * * *